US012669031B2

(12) United States Patent
Albeshri et al.

(10) Patent No.: US 12,669,031 B2
(45) Date of Patent: Jun. 30, 2026

(54) WIRELINE SUBSURFACE SAFETY VALVE SYSTEMS, SUBSURFACE SAFETY VALVE TOOLS, AND METHODS OF LOCKING SUBSURFACE SAFETY VALVES

(71) Applicant: Saudi Arabian Oil Company, Dhahran (SA)

(72) Inventors: Raissan F. Albeshri, Safwa (SA); Hussain S. Hunidi, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 19 days.

(21) Appl. No.: 18/365,422

(22) Filed: Aug. 4, 2023

(65) Prior Publication Data

US 2025/0043658 A1 Feb. 6, 2025

(51) Int. Cl.
*E21B 34/14* (2006.01)

(52) U.S. Cl.
CPC ..... *E21B 34/14* (2013.01); *E21B 2200/05* (2020.05)

(58) Field of Classification Search
CPC ..... E21B 34/14; E21B 34/08; E21B 2200/05; E21B 23/02
See application file for complete search history.

(56) References Cited

U.S. PATENT DOCUMENTS 4,641,707 A * 2/1987 Akkerman ..... E21B 34/102 166/143
6,056,055 A * 5/2000 Falconer ..... E21B 34/14 166/381
9,273,535 B1 * 3/2016 George ..... E21B 34/108
12,006,791 B2 * 6/2024 Alssamen ..... E21B 33/06
2007/0012872 A1 * 1/2007 Poland ..... G01D 5/35358 250/227.14
2013/0043044 A1 * 2/2013 Garber ..... E21B 21/106 166/325
2015/0275620 A1 * 10/2015 Scott ..... E21B 23/02 166/53
2024/0102361 A1 * 3/2024 Dearborn ..... E21B 37/00
2024/0141752 A1 * 5/2024 Alghamdi ..... E21B 34/14

FOREIGN PATENT DOCUMENTS

EP 1809860 B1 5/2010
EP 2118439 B1 1/2012

* cited by examiner

*Primary Examiner* — Tara Schimpf
*Assistant Examiner* — Ursula Lee Norris
(74) *Attorney, Agent, or Firm* — Dinsmore & Shohl, LLP

(57) ABSTRACT

A subsurface safety valve tool includes a body having an upper portion positioned upstream of a subsurface safety valve and a lower portion that extends into and through the an interior bore and a hinged valve of the subsurface safety valve, and at least one protrusion extending from an exterior surface of the upper portion of the body, such that the at least one protrusion abuts a fishneck of the subsurface safety valve when the body is positioned within the interior bore of the subsurface safety valve. The subsurface safety valve tool prevents the subsurface safety valve from translating from an open position to a closed position when the subsurface safety valve tool is positioned within the interior bore of the subsurface safety valve.

15 Claims, 4 Drawing Sheets

WIRELINE SUBSURFACE SAFETY VALVE SYSTEMS, SUBSURFACE SAFETY VALVE TOOLS, AND METHODS OF LOCKING SUBSURFACE SAFETY VALVES

TECHNICAL FIELD

The present specification generally relates to tools for drilling operations, and more specifically to tools for subsurface safety valves.

BACKGROUND

Subsurface Safety valves are commonly deployed after drilling operations as a means to shut-in a wellbore in the event the integrity of a surface wellhead is compromised during operation. However, current subsurface safety valves commonly experience a number of failures and malfunctions when engaged. For instance, over time, damage to the safety valve may result in uncommanded closure of the safety valve during well intervention. This uncommanded closure may result in wireline that extends through the subsurface safety valve being severed, which may in turn cause the wireline and additional toolstring gear to be lost within the wellbore. Thus, a need exists for additional tools or methods capable of ensuring that subsurface safety valves are not inadvertently closed during well intervention.

SUMMARY

In an embodiment, a subsurface safety valve is disclosed. The subsurface safety valve includes an interior bore extending along an entire length of the subsurface safety valve and a hinged valve actuatable between an open position and a closed position. The hinged valve creates a fluid-tight seal with the interior bore in the closed position. The subsurface safety valve further includes a fishneck disposed upstream of the hinged valve that is configured to receive at least a portion of a subsurface safety valve tool. The subsurface safety valve tool includes a body having an upper portion positioned upstream of the subsurface safety valve and a lower portion that extends into and through the interior bore and hinged valve of the subsurface safety valve, and at least one protrusion that extends from an exterior surface of the upper portion of the body, such that the at least one protrusion abuts the fishneck of the subsurface safety valve when the body is positioned within the interior bore of the subsurface safety valve. The subsurface safety valve tool prevents the subsurface safety valve from translating from the open position to the closed position when the subsurface safety valve tool is positioned within the interior bore of the subsurface safety valve.

In another embodiment, a subsurface safety valve tool for a subsurface safety valve is disclosed. The subsurface safety valve tool includes a body having an upper portion positioned upstream of the subsurface safety valve and a lower portion that extends into and through the interior bore and hinged valve of the subsurface safety valve, and at least one protrusion that extends from an exterior surface of the upper portion of the body, such that the at least one protrusion abuts the fishneck of the subsurface safety valve when the body is positioned within the interior bore of the subsurface safety valve;

In yet another embodiment, a method of locking a subsurface safety valve is disclosed. The method includes positioning a subsurface safety valve having an interior bore into a wellbore; translating a valve of the subsurface safety valve from a closed position to an open position; coupling a subsurface safety valve tool having a body including an upper portion and a lower portion to a wireline; positioning the subsurface safety valve tool within the interior bore of the subsurface safety valve, such that the subsurface safety valve tool extends through the valve; securing the subsurface safety valve tool to the subsurface safety valve; testing an integrity of the coupling between the subsurface safety valve tool and the subsurface safety valve; decoupling the wireline from the subsurface safety valve tool; and removing the wireline from the wellbore.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
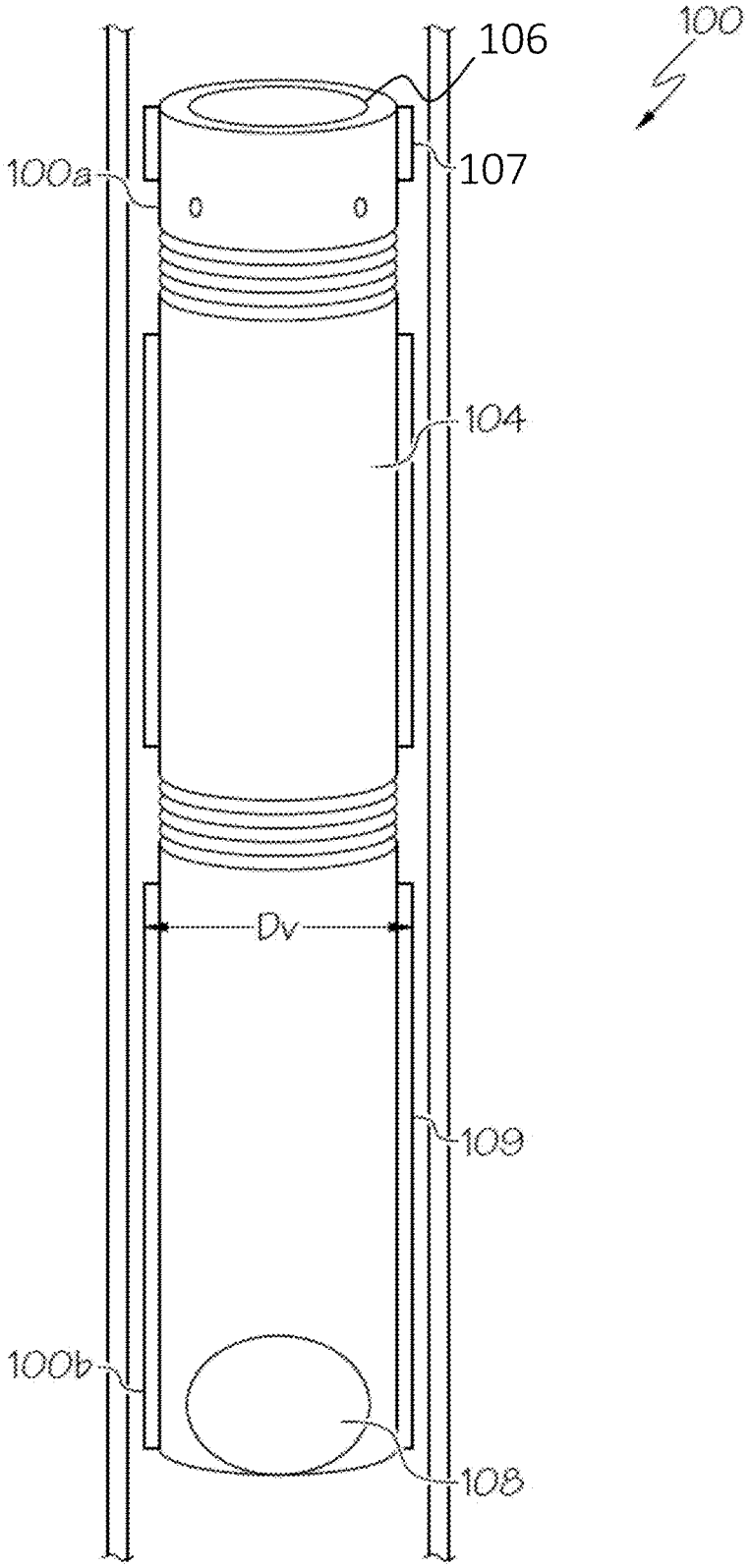
FIG. 1 depicts a cross-sectional schematic view of a subsurface safety valve, according to one or more embodiments shown and described herein.

Embodiments disclosed herein relate to subsurface safety valves, subsurface safety valve tools, and methods of locking subsurface safety valves. More specifically, the present disclosure includes a subsurface safety valve tool that includes a body having a cone-shaped portion that extends through a subsurface safety valve to lock the subsurface safety valve in an open position during well intervention operations.

As described in additional detail herein, the disclosed subsurface safety valve may include an interior bore extending along an entire length of the subsurface safety valve, a hinged valve actuatable between an open position and a closed position, and a fishneck disposed upstream of the hinged valve. In embodiments, the fishneck may be configured to receive at least a portion of a subsurface safety valve tool. The subsurface safety valve tool may include a body having an upper portion positioned upstream of the subsurface safety valve and a lower portion that extends into and through the interior bore and hinged valve of the subsurface safety valve. The subsurface safety valve tool may further include at least one protrusion extending from an exterior surface of the upper portion of the body, such that the at least one protrusion abuts the fishneck of the subsurface safety valve when the body is positioned within the interior bore of the subsurface safety valve. In these embodiments, the subsurface safety valve tool prevents the subsurface safety valve from translating from the open position to the closed position when the subsurface safety valve tool is positioned within the interior bore of the subsurface safety valve.

As provided herein, the term "subsurface safety valve tool" may generally refer to any tool that may be passed over a wireline and secured to a subsurface safety valve such that the tool extends into and at least partially through the subsurface safety valve in order to lock the subsurface safety valve in a desired position.

As provided herein, the term "safety valve" may generally refer to a valve designed to automatically shut-in the flow of a wellbore in the event surface controls fail or surface equipment becomes damaged.

As provided herein, the term "subsurface safety valve" may refer to a safety valve which is includes a subsurface control mechanism designed to automatically close (e.g., actuated by the pressure differential/flow velocity across the safety valve) when a predetermined flow condition occurs in the wellbore.

As provided herein, the term "wireline subsurface safety valve ('WLSSSV')" may refer to a type of subsurface safety valve that is run and retrieved by wireline or slickline.

As provided herein, the term "slickline" may refer to a thin, nonelectric cable used for selective placement and retrieval of wellbore hardware, such as plugs, gauges, and valves located in mandrels.

As provided herein, the term "wireline" may refer to an electric cable used to lower tools into a borehole and to transmit data to a control system positioned at a surface of the borehole.

As provided herein, the term "well intervention operations" may refer to activities performed on an oil or gas well to restore, enhance, and/or maintain its productivity. These operations may include operations to optimize well performance, address production issues, or perform maintenance tasks. For example, well intervention operations may include, but are not limited to, well stimulation, well logging, wellhead maintenance, tubing and/or casing repair, plug and abandonment operations, well cleanout, and/or perforation.

As provided herein, the term "fishneck" may refer to a region of a subsurface safety valve or other drill string member having a reduced diameter at or near an upper portion of the safety valve. The fishneck may be used to couple fishing tools (e.g., subsurface safety valve tool, etc.) to the subsurface safety valve.

As discussed herein, many currently used subsurface safety valves present a number of reliability issues that often require substantial repairs throughout operation of the valve. For example, malfunctions with the subsurface safety valve may result in unprompted closing of the valve, which can crush or rupture the control lines used to operate the valve, or the wireline that extends through the valve. Further still, the unprompted closure of the safety valve can cause leaks in the seals and/or junctions of the valve. When subsurface safety valves having pressure equalization mechanisms are employed, leaks within the seals and/or junctions of the valves may render the valves inoperable, as equalized pressure may be required to open the valve. Moreover, these malfunctions are not easily remedied, and often require removing the subsurface safety valve from the wellbore entirely in order to repair. However, in accordance with an embodiment of the present invention, a subsurface safety valve tool having a body that extends into and through an interior bore of the safety valve may be deployed in order to effectively secure the valve in an open position. By securing (e.g., locking) the valve in the open position, the disclosed subsurface safety valve tool may act as a safeguard to ensure that sudden malfunction of the valve is prevented during wellbore operations.

Embodiments of the subsurface safety valve tool and methods of locking a subsurface safety valve will now be described in more detail herein. The following will now describe these tools and methods in more detail with reference to the drawings and where like numbers refer to like structures.

Figure 2:
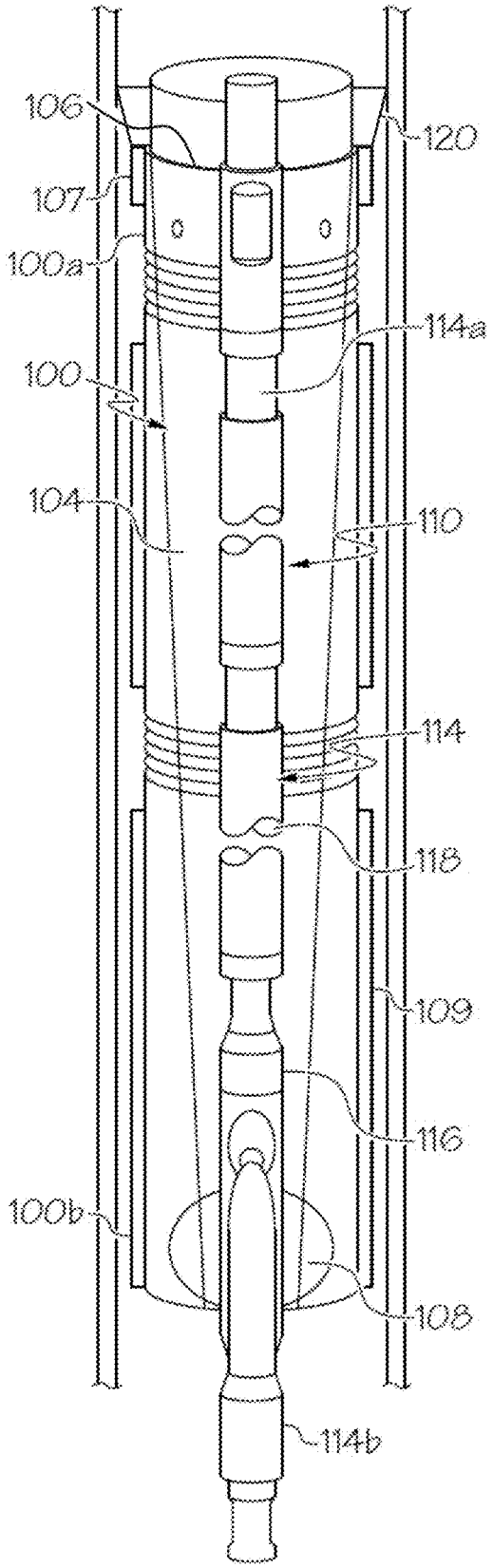
FIG. 2 depicts a cross-sectional schematic view of a subsurface safety valve coupled to a subsurface safety valve tool, according to one or more embodiments shown and described herein.

Referring now to FIGS. 1 and 2, a subsurface safety valve 100, such as a WLSSSV, is depicted. The subsurface safety valve 100 may include an interior bore 104, which may extend along an entire length of the subsurface safety valve 100 (e.g., between a proximal end 100*a* and a distal end 100*b* of the subsurface safety valve 100). In some embodiments, the interior bore 104 may have a diameter Dv that is sufficiently large to accommodate a slickline or other similar device, such that a wellbore may be accessible through the interior bore 104.

In these embodiments, the subsurface safety valve 100 may further include a fishneck 106 disposed on the proximal end 100*a* of the subsurface safety valve 100. The fishneck 106 may be configured to receive a fishing tool (e.g., subsurface safety valve tool), as will be described in additional detail herein.

Referring still to FIGS. 1 and 2, the subsurface safety valve 100 may be further equipped with a hinged valve 108, such as a flapper valve, which may be actuatable between an open position and a closed position using a control line 109. When adequate reservoir pressure is maintained within the subsurface safety valve 100, the hinged valve 108 may remain in the open position, such that the wellbore is accessible through the interior bore 104 of the subsurface safety valve 100. However, if the pressure within the subsurface safety valve 100 drops below a predetermined threshold (e.g., as occurs in the beginning stages of losing control of the wellbore), the hinged valve 108 may be actuated to the closed position. In these embodiments, "adequate reservoir pressure" may be determined by adding the reservoir pressure to the pressure supplied by the hinged valve 108 (e.g., via a spring or other similar mechanism) and subtracting the hydrostatic pressure of hydraulic fluid inside the control line 109.

Although the hinged valve 108 may be configured to actuate from the open position to the closed position when pressure within the subsurface safety valve 100 drops below the predetermined threshold, it should be appreciated that, in some embodiments, malfunctions within the subsurface safety valve 100 may cause the hinged valve 108 to actuate to the closed position unprompted. To alleviate the risk of the hinged valve 108 inadvertently actuating to the closed position, a subsurface safety valve tool may be disposed within the interior bore 104 of the subsurface safety valve 100, as will be described in additional detail herein with reference to FIGS. 2 and 3.

Referring now to FIG. 2, the subsurface safety valve 100 is depicted with a subsurface safety valve tool 110 installed within the interior bore 104 of the subsurface safety valve 100. In these embodiments, the subsurface safety valve tool 110 may include a body 114 disposed within the interior bore 104 of the subsurface safety valve 100. In these embodiments, the body 114 may extend between an upper portion 114*a* and a lower portion 114*b*. As depicted in FIG. 2, the body 114 may be positioned within the interior bore 104 such that the upper portion 114*a* of the body 114 is disposed upstream of the proximal end 100*a* of the subsurface safety valve 100, while the lower portion 114*b* of the body 114 may extend into and through the interior bore 104 and hinged valve 108 of the subsurface safety valve 100.

In these embodiments, the upper portion 114*a* may be a stainless steel section, which is manufactured to withstand high pressures and high temperature that may be encountered within the wellbore and/or during wellbore processes. Furthermore, the lower portion 114*b* of the subsurface safety valve tool 100 may be a brass section. For example, brass materials may be capable of maintaining the subsurface safety valve 100 in the open position without damaging internal components of the subsurface safety valve 100. Additionally, it should be appreciated that brass material may be non-magnetic and non-sparking, which may help to ensure that the lower section 114*b* does not spark and/or attract magnetized components within the subsurface safety valve 100 when the lower section 114*b* is positioned within the interior bore 104.

Figure 3:
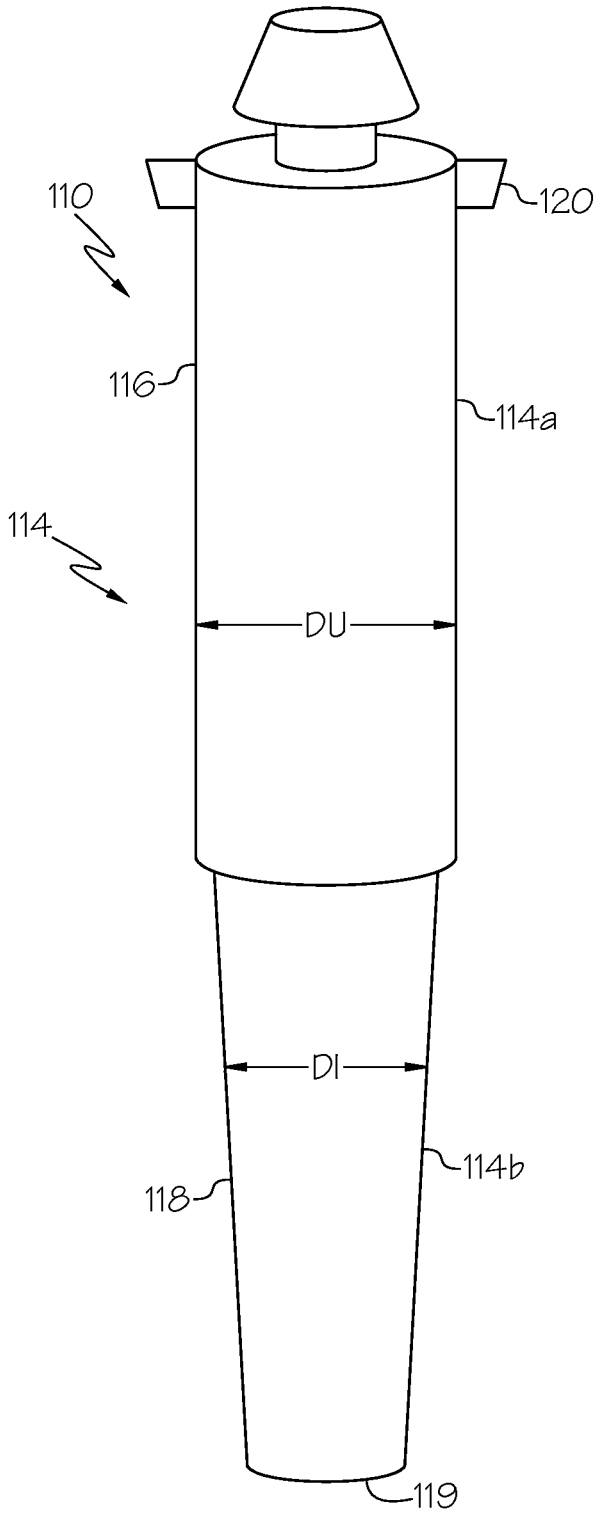
FIG. 3 depicts a perspective view of the subsurface safety valve tool of FIG. 2, according to one or more embodiments shown and described herein.

As further depicted in FIGS. 2 and 3, the body 114 may include an exterior surface 116 and an interior surface 118. In these embodiments, the exterior surface 116 may include a cone-shaped profile, such that the upper portion 114*a* of the body 114 has an upper portion diameter Du that is greater than a lower portion diameter D1 of the lower portion 114*b* of the body 114. Furthermore, the exterior surface 116 may be tapered from the upper portion 114*a* to the lower portion 114*b* of the body 114, thereby providing the body 114 with the cone-shaped profile. Furthermore, in the embodiments described herein, the upper portion diameter Du of the upper portion 114*a* of the body 114 may be larger than the diameter of the proximal end 100*a* of the subsurface safety valve 100, while the diameter of the lower portion 114*b* of the body 114 may be smaller than the diameter Dv of the interior bore 104 of the subsurface safety valve 100. Accordingly, the upper portion 114*a* of the body 114 may remain outside (e.g., upstream) of the proximal end 100*a* of the subsurface safety valve 100, while the lower portion 114*b* of the body extends into and through the interior bore 104 and the hinged valve 108 of the subsurface safety valve 100.

Referring still to FIGS. 2 and 3, in these embodiments, at least a portion of the exterior surface 116 of the body 114 may be shaped to conform to the interior bore 104 of the subsurface safety valve 100. For example, in the embodiment depicted in FIG. 2, the lower portion 114*b* of the body 114 may be shaped to conform to the interior bore 104 of the subsurface. Thus, although the lower portion 114*b* of the body 114 is depicted as being cone-shaped, it should be understood that the lower portion 114*b* of the body 114 may take any shape (e.g., rectangular, etc.) such that the exterior surface 116 corresponds to the shape of the interior bore 104.

In embodiments, it should be further appreciated that the body 114 may be a hollow body. For example, the interior surface 118 of the body 114 of the subsurface safety valve tool 110 may further define an internal bore 119. The internal bore 119 may extend along the entire length of the subsurface safety valve tool 110 (e.g., between the upper portion 114*a* and the lower portion 114*b*), such that the wellbore may remain accessible through the internal bore 119 of the subsurface safety valve tool 110 when the subsurface safety valve tool 110 is installed within the subsurface safety valve 100.

As further depicted in FIGS. 2 and 3, the subsurface safety valve tool 110 may include at least one protrusion 120 that extends from the exterior surface 116 of the upper portion 114*a* of the body 114. In these embodiments, the at least one protrusion 120 may abut the fishneck 106 of the subsurface safety valve 100 when the subsurface safety valve tool 110 is coupled to the subsurface safety valve 100. The at least one protrusion 120 may aid in ensuring that the upper portion 114*a* of the body 114 does not interact and/or interfere with the hinged valve 108 when the lower portion 114*b* of the body 114 is disposed within the interior bore 104 of the subsurface safety valve 100.

In some embodiments, the fishneck 106 may further include a locking mechanism 107 that may be used to lock the at least one protrusion 120 to the fishneck 106 when the subsurface safety valve tool 110 is disposed within the subsurface safety valve 100. For example, the locking mechanism 107 may include a latch, a clamp, or any other similar mechanism capable of coupling the at least one protrusion 120 to the fishneck 106. In these embodiments, the locking mechanism 107 may ensure that the subsurface safety valve tool 110 does not become dislodged or otherwise misaligned during wellbore production.

In operation, the subsurface safety valve tool 110 may be installed in the subsurface safety valve 100 by attaching the subsurface safety valve tool 110 to a slickline or wireline. Once the subsurface safety valve tool 110 and the slickline are coupled, the slickline may be run into the subsurface safety valve 100. As the slickline and subsurface safety valve tool 110 are lowered, the hinged valve 108 of the subsurface safety valve 100 may be opened by adjusting the pressure in the control line 109, as has been described herein. With the hinged valve 108 moved to the open position, the slickline and subsurface safety valve tool 110 may be lowered into the interior bore 104 of the subsurface safety valve 100, such that the lower portion 114*b* of the body 114 may extend into and through the hinged valve 108 and the interior bore 104 and the at least one protrusion 120 of the subsurface safety valve tool 110 contacts the fishneck 106 of the subsurface safety valve 100. Once the subsurface safety valve tool 110 is appropriately positioned, the locking mechanism 107 may couple the subsurface safety valve tool 110 to the subsurface safety valve 100, at which point the slickline or wireline may be withdrawn.

Furthermore, once the subsurface safety valve tool 110 has been installed within the interior bore 104 of the subsurface safety valve 100, a user may ensure that the coupling between the subsurface safety valve tool 110 and the subsurface safety valve 100 is of a desired integrity. More specifically, testing may be conducted to ensure that no defects are present between the subsurface safety valve tool 110 and the subsurface safety valve 100. Ensuring the integrity of the coupling between the subsurface safety valve tool 110 and the subsurface safety valve 100 may serve to eliminate the risk of the hinged valve 108 inadvertently closing during wellbore production, as has been described herein.

With the subsurface safety valve tool 110 positioned and secured within the subsurface safety valve 100, the lower portion 114*b* of the body 114 (e.g., the portion which extends into and through the interior bore 104 and hinged valve 108) of the subsurface safety valve tool 110 may act to lock the hinged valve 108 in the opened position. For example, with the subsurface safety valve tool 110 positioned, the hinged valve 108 may be incapable of moving from the open position to the closed position, as the lower portion 114*b* of the body 114 acts to obstruct the hinged valve 108. In these embodiments, in the hinged valve 108 suffers a malfunction, the lower portion 114*b* of the body 114 of the subsurface safety valve tool 110 may contact the hinged valve 108, such that the hinged valve 108 is held in the open position. With the hinged valve 108 secured in the open position, the malfunction may be addressed by a user without suffering damage and/or loss to any tool strings, wirelines, and/or fishing tools that may be operating in the wellbore at the time of the malfunction.

Figure 4:
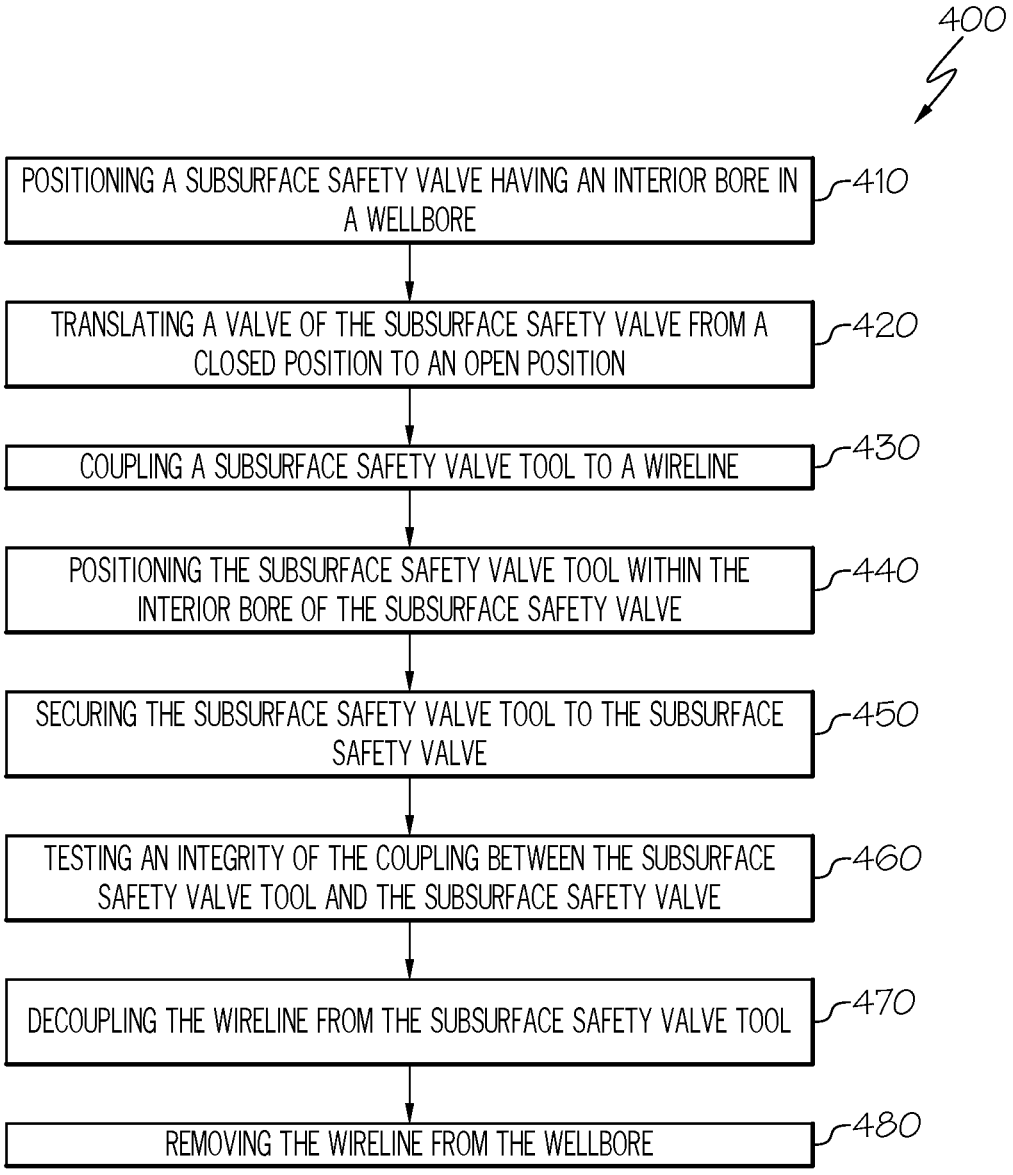
FIG. 4 depicts an illustrative flow diagram of a method of locking a subsurface safety valve, according to one or more embodiments shown and described herein.

Turning now to FIG. 4, an illustrative flow diagram of a method 400 for coupling a subsurface safety valve tool to a subsurface safety valve is described. As illustrated at block 410, the method may begin with positioning a subsurface safety valve having an interior bore into a wellbore. The subsurface safety valve may be positioned in the wellbore via a slickline or any other suitable means.

With the subsurface safety valve positioned in the wellbore, the method may proceed to block 420, which may involve translating a valve, such as a hinged valve, of the subsurface safety valve from a closed position to an open position. With the valve in the open position, the method may advance to block 430, which may involve coupling a subsurface safety valve tool having a body including an upper portion and a lower portion to a wireline.

As further depicted in FIG. 4, the method may further involve positioning the subsurface safety valve tool within the interior bore of the subsurface safety valve, such that the subsurface safety valve tool extends into and through the valve and the interior bore of the subsurface safety valve, as shown at block 440. For example, in these embodiments, the subsurface safety valve tool may be positioned within the subsurface safety valve such that the lower portion of the body of the subsurface safety valve tool obstructs the valve, thereby preventing the valve from moving from the open position to the closed position. Furthermore, in these embodiments, the upper portion of the body of the subsurface safety valve tool may be positioned such that a protrusion extending from the upper portion of the body of the subsurface safety valve tool abuts and/or is positioned upstream of a fishneck formed on the subsurface safety valve.

With the subsurface safety valve tool positioned within the subsurface safety valve, the method may proceed to block 450, which may involve securing the subsurface safety valve tool to the subsurface safety valve. For example, in some embodiments, the method of block 450 may involve locking the upper portion of the subsurface safety valve tool to the subsurface safety valve in order to ensure that the subsurface safety valve tool does not become dislodged during wellbore production.

Once the subsurface safety valve tool is secured to the subsurface safety valve, in some embodiments, the method may further involve testing an integrity of the coupling between the subsurface safety valve tool and the subsurface safety valve, as is depicted at block 460.

In the event the integrity of the coupling between the subsurface safety valve tool and the subsurface safety valve is confirmed, the method may proceed to block 470 and block 480, which may involve decoupling the wireline from the subsurface safety valve tool and removing the wireline from the wellbore, respectively. With the subsurface safety valve tool secured to the subsurface safety valve and the wireline removed, wellbore production activities may be commenced.

As should be appreciated in view of the foregoing, a subsurface safety valve, subsurface safety valve tool, and method of locking a subsurface safety valve are described herein.

Embodiments may be further described with reference to the following numbered clauses:

Clause 1. A subsurface safety valve comprising: an interior bore extending along an entire length of the subsurface safety valve; a hinged valve actuatable between an open position and a closed position, wherein the hinged valve creates a fluid-tight seal with the interior bore in the closed position; and a fishneck disposed upstream of the hinged valve, the fishneck being configured to receive at least a portion of a subsurface safety valve tool, wherein the subsurface safety valve tool comprises: a body having an upper portion positioned upstream of the subsurface safety valve and a lower portion that extends into and through the interior bore and hinged valve of the subsurface safety valve; and at least one protrusion extending from an exterior surface of the upper portion of the body, such that the at least one protrusion abuts the fishneck of the subsurface safety valve when the body is positioned within the interior bore of the subsurface safety valve; wherein the subsurface safety valve tool prevents the subsurface safety valve from translating from the open position to the closed position when the subsurface safety valve tool is positioned within the interior bore of the subsurface safety valve.

Clause 2. The subsurface safety valve of clause 1, further comprising a control line for controlling the subsurface safety valve at a surface of a wellbore.

Clause 3. The subsurface safety valve of clause 1 or 2, wherein the body of the subsurface safety valve tool is a hollow body.

Clause 4. The subsurface safety valve of any of clauses 1-3, wherein the subsurface safety valve tool is installed in a wellbore via a wireline.

Clause 5. The subsurface safety valve of any of clauses 1-4, wherein the body of the subsurface safety valve tool includes a cone-shaped profile.

Clause 6. The subsurface safety valve of any of clauses 1-5, wherein the lower portion of the body of the subsurface safety valve tool is made of brass.

Clause 7. The subsurface safety valve of any of clauses 1-6, wherein the fishneck further includes a locking mechanism for coupling the at least one protrusion of the subsurface safety valve tool to the fishneck.

Clause 8. The subsurface safety valve of any of clauses 1-7, wherein the body of the subsurface safety valve is a stainless steel body.

Clause 9. A subsurface safety valve tool for a subsurface safety valve, the subsurface safety valve tool comprising: a body having an upper portion positioned upstream of the subsurface safety valve and a lower portion that extends into and through the interior bore and hinged valve of the subsurface safety valve; and at least one protrusion extending from an exterior surface of the upper portion of the body, such that the at least one protrusion abuts the fishneck of the subsurface safety valve when the body is positioned within the interior bore of the subsurface safety valve.

Clause 10. The subsurface safety valve tool of clause 9, wherein the subsurface safety valve tool locks the subsurface safety valve in an open position when the subsurface safety valve tool is positioned within the subsurface safety valve.

Clause 11. The subsurface safety valve tool of clauses 9 or 10, wherein the body of the subsurface safety valve tool is a hollow body.

Clause 12. The subsurface safety valve tool of any of clauses 9-11, wherein the subsurface safety valve tool is installed in the wellbore via a wireline.

Clause 13. The subsurface safety valve tool of any of clauses 9-12, wherein the body of the subsurface safety valve tool includes a cone-shaped profile.

Clause 14. The subsurface safety valve tool of any of clauses 9-13, wherein the lower portion of the body of the subsurface safety valve tool is made of brass.

Clause 15. A method of locking a subsurface safety valve, the method comprising: positioning a subsurface safety valve having an interior bore into a wellbore; translating a valve of the subsurface safety valve from a closed position to an open position; coupling a subsurface safety valve tool having a body including an upper portion and a lower portion to a wireline; positioning the subsurface safety valve tool within the interior bore of the subsurface safety valve, such that the subsurface safety valve tool extends through the valve; securing the subsurface safety valve tool to the subsurface safety valve; testing an integrity of the coupling between the subsurface safety valve tool and the subsurface safety valve; decoupling the wireline from the subsurface safety valve tool; and removing the wireline from the wellbore.

Clause 16. The method of clause 15, wherein the subsurface safety valve tool is positioned within the interior bore of the subsurface safety valve such that the upper portion of the body of the subsurface safety valve tool extends out of the interior bore and the lower portion of the body of the subsurface safety valve extends through the interior bore.

Clause 17. The method of clauses 15 or 16, wherein the method step of positioning the subsurface safety valve tool within the interior bore of the subsurface safety valve further comprises positioning at least one protrusion formed on the upper portion of the body of the subsurface safety valve tool upstream of a fishneck formed on the subsurface safety valve.

Clause 18. The method of any of clauses 15-17, wherein the method step of securing the subsurface safety valve tool to the subsurface safety valve further comprises locking the upper portion of the subsurface safety valve tool to the subsurface safety valve.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A subsurface safety valve comprising:

an interior bore extending along an entire length of the subsurface safety valve;

a hinged valve actuatable between an open position and a closed position, wherein the hinged valve creates a fluid-tight seal with the interior bore in the closed position; and a fishneck formed at an uppermost end of the subsurface safety valve and having at least a portion of a subsurface safety valve tool received therein, wherein the subsurface safety valve tool comprises:

a body having an upper portion positioned upstream of the subsurface safety valve and a lower portion that extends into and through the interior bore and hinged valve of the subsurface safety valve; and at least one protrusion extending from an exterior surface of the upper portion of the body, such that the at least one protrusion rests atop the fishneck of the subsurface safety valve when the body is positioned within the interior bore of the subsurface safety valve;

wherein the subsurface safety valve tool prevents the subsurface safety valve from translating from the open position to the closed position when the subsurface safety valve tool is positioned within the interior bore of the subsurface safety valve.

2. The subsurface safety valve of claim 1, further comprising a control line for controlling the subsurface safety valve at a surface of a wellbore.

3. The subsurface safety valve of claim 1, wherein the body of the subsurface safety valve tool is a hollow body.

4. The subsurface safety valve of claim 1, wherein the subsurface safety valve tool is installed in a wellbore via a wireline.

5. The subsurface safety valve of claim 1, wherein the body of the subsurface safety valve tool includes a cone-shaped profile.

6. The subsurface safety valve of claim 1, wherein the lower portion of the body of the subsurface safety valve tool is made of brass.

7. The subsurface safety valve of claim 1, wherein the body of the subsurface safety valve is a stainless steel body.

8. A subsurface safety valve tool for a subsurface safety valve, the subsurface safety valve tool comprising:

a body having an upper portion positioned upstream of the subsurface safety valve and a lower portion that extends into and through the interior bore and hinged valve of the subsurface safety valve; and at least one protrusion extending from an exterior surface of the upper portion of the body, such that the at least one protrusion rests atop a fishneck formed at an uppermost end of the subsurface safety valve when the body is positioned within the interior bore of the subsurface safety valve.

9. The subsurface safety valve tool of claim 8, wherein the subsurface safety valve tool locks the subsurface safety valve in an open position when the subsurface safety valve tool is positioned within the subsurface safety valve.

10. The subsurface safety valve tool of claim 8, wherein the body of the subsurface safety valve tool is a hollow body.

11. The subsurface safety valve tool of claim 8, wherein the subsurface safety valve tool is installed in a wellbore via a wireline.

12. The subsurface safety valve tool of claim 8, wherein the body of the subsurface safety valve tool includes a cone-shaped profile.

13. The subsurface safety valve tool of claim 8, wherein the lower portion of the body of the subsurface safety valve tool is made of brass.

14. A method of locking a subsurface safety valve, the method comprising:

positioning the subsurface safety valve having an interior bore into a wellbore;

translating a valve of the subsurface safety valve from a closed position to an open position;

coupling a subsurface safety valve tool having a body including an upper portion and a lower portion to a wireline;

positioning the subsurface safety valve tool within the interior bore of the subsurface safety valve, such that the subsurface safety valve tool extends through the valve and at least one protrusion formed on the upper portion of the body of the subsurface safety valve tool rests atop a fishneck formed at an uppermost end of the subsurface safety valve;

testing an integrity of the coupling between the subsurface safety valve tool and the subsurface safety valve;

decoupling the wireline from the subsurface safety valve tool; and removing the wireline from the wellbore.

15. The method of claim 14, wherein the subsurface safety valve tool is positioned within the interior bore of the subsurface safety valve such that the upper portion of the body of the subsurface safety valve tool extends out of the interior bore and the lower portion of the body of the subsurface safety valve extends through the interior bore.

* * * * *